US011408585B1

(12) United States Patent
Wang

(10) Patent No.: US 11,408,585 B1
(45) Date of Patent: Aug. 9, 2022

(54) WATERPROOF AND SHATTERPROOF LIGHT STRING

(71) Applicant: DONGGUAN GUANYI LIGHT-DECORATION CO., LTD., Dongguan (CN)

(72) Inventor: Shifang Wang, Dongguan (CN)

(73) Assignee: DONGGUAN GUANYI LIGHT-DECORATION CO., LTD., Dongguan (CN)

( * ) Notice: Subject to any disclaimer, the term of this patent is extended or adjusted under 35 U.S.C. 154(b) by 0 days.

(21) Appl. No.: 17/404,988

(22) Filed: Aug. 17, 2021

(30) Foreign Application Priority Data

Jul. 27, 2021 (CN) ..... 202121719170.7

(51) Int. Cl.

| | |
|---|---|
| ***F21V 3/06*** | (2018.01) |
| ***F21S 4/10*** | (2016.01) |
| ***F21V 31/00*** | (2006.01) |
| ***F21V 23/06*** | (2006.01) |
| ***F21V 23/00*** | (2015.01) |

(52) U.S. Cl.
CPC ..... *F21V 3/062* (2018.02); *F21S 4/10* (2016.01); *F21V 23/001* (2013.01); *F21V 23/06* (2013.01); *F21V 31/00* (2013.01)

(58) Field of Classification Search
CPC ..... F21V 23/06; F21V 23/001; F21V 3/062; F21S 4/10
See application file for complete search history.

(56) References Cited

U.S. PATENT DOCUMENTS

| | | | | |
|---|---|---|---|---|
| 5,722,853 | A * | 3/1998 | Hwang | F21V 21/002 439/340 |
| 5,848,909 | A * | 12/1998 | Tsai | H01R 33/22 439/206 |
| 6,010,346 | A * | 1/2000 | Wang | F21V 21/002 439/340 |
| 7,377,802 | B2 * | 5/2008 | Allen | H01R 29/00 439/490 |
| 8,651,711 | B2 * | 2/2014 | Rudisill | F21V 21/096 362/249.02 |
| 2006/0270250 | A1 * | 11/2006 | Allen | F21S 4/26 439/43 |
| 2007/0218753 | A1 * | 9/2007 | Tsai | H01R 25/003 439/419 |
| 2008/0013324 | A1 * | 1/2008 | Yu | F21V 3/02 362/311.06 |

* cited by examiner

*Primary Examiner* — Leah Simone Macchiarolo

(57) ABSTRACT

The present disclosure relates to the technical field of decorative lamps and discloses a waterproof and shatterproof light string, including an electric wire. A female socket is arranged at one end of the electric wire, and a male plug capable of being plugged and electrically connected with the female socket is arranged at the other end of the electric wire, and a plurality of lamps are arranged in the middle of the electric wire in parallel; the lamp includes a lamp holder and a bulb connected with the lamp holder, and a gap is arranged between the lamp holder and the bulb; a water discharge port is formed in one side of the lamp holder; and the bulb includes a shatterproof plastic bulb shell.

11 Claims, 6 Drawing Sheets

WATERPROOF AND SHATTERPROOF LIGHT STRING

TECHNICAL FIELD

The disclosure herein relates to the technical field of decorative lamps, in particular to a waterproof and shatterproof light string.

BACKGROUND

With the popularization of electricity, lamps have been used in thousands of households. People are no longer limited to using lamps for ordinary lighting, and they are more inclined to use lamps to create different atmospheres. For example, at the party, lamps emitting different light in color are made into a light string then to be fixed to artificial trees, walls, fences, indoor ceilings and other places to set off the atmosphere of the party by contrast, and add fun and artistic effects, and the like.

There are all kinds of decorative light strings on the market, but traditional light strings still have some shortcomings. On one hand, the existing light string will inevitably collide, squeeze, fall to the ground and the like during use, so it is very easy to break; on the other hand, lamps on the light string do not have a waterproof function, in use, they are very easily affected by the external environment, and for example, rain or manually accidental spreading of water to the light string can easily damage the light string, making the application range of the light string too small to meet the needs of people. In view of this, the inventor has made a new disclosure.

SUMMARY

The present disclosure aims to provide a waterproof and shatterproof light string which has characteristics of being waterproof and shatterproof aiming at defects in the prior art.

In order to achieve the above purpose, the present disclosure is a waterproof and shatterproof light string including an electric wire. A female socket is arranged at one end of the electric wire, and a male plug capable of being plugged and electrically connected with the female socket is arranged at the other end of the electric wire, and a plurality of lamps are arranged in the middle of the electric wire in parallel; the lamp includes a lamp holder and a bulb connected with the lamp holder, and a gap is arranged between the lamp holder and the bulb; a water discharge port is formed in one side of the lamp holder; and the bulb includes a shatterproof plastic bulb shell.

Further, the female socket is provided with a first jack and a second jack, and the first jack is greater than the second jack.

Further, the male plug is provided with a first male tab and a second male tab, the first male tab is greater than the second male tab, the first male tab is matched with the first jack, and the second male tab is matched with the second jack.

Preferably, the male plug is provided with an inner cavity, and a plurality of security devices are plugged in a cavity body; and the inner cavity is connected with a sliding cover in a sliding mode, and the sliding cover is provided with a plurality of protruding strips.

Further, the security device includes a fusant and supporting electrodes, and two ends of the fusant are connected with the supporting electrodes.

Further, the lamp holder includes a holder body and a tail hood, and the holder body and the tail hood are connected in a clamped mode.

Further, a rotating accommodating position is arranged in the holder body, a first conductive terminal is arranged on a side surface of the rotating accommodating position, a second conductive terminal is arranged at a bottom, and the first conductive terminal and the second conductive terminal are each provided with a pointed protruding portion for puncturing a wire rod.

Furthermore, the holder body further includes a wire accommodating groove and two sides of the wire accommodating groove are provided with buckling positions.

Further, the tail hood is provided with clamping tongues capable of being connected with the buckling positions in a clamped mode, and the tail hood is further provided with a wire pressing strip for abutting against the wire rod.

Preferably, an edge side of the tail hood is provided with a hook.

Beneficial effects: compared with the prior art, the present disclosure is the waterproof and shatterproof light string, including the electric wire. The female socket is arranged at one end of the electric wire, and the male plug capable of being plugged and electrically connected with the female socket is arranged at the other end of the electric wire, and the plurality of lamps are arranged in the middle of the electric wire in parallel; the lamp includes the lamp holder and the bulb connected with the lamp holder, and the gap is arranged between the lamp holder and the bulb; the water discharge port is formed in one side of the lamp holder; and the bulb includes the shatterproof plastic bulb shell. The present disclosure has the following advantages that 1. the light string has a waterproof function, is not easily affected by the external environment, and has a wider application range; 2. the bulb has a shatterproof function, and is long in service life, easy to transport, and the like; 3. the design that the size of the jack corresponds to the size of the male tab is adopted, the situation that due to mistaken plugging, a short circuit is caused and the light string cannot be used does not occur in use, connection efficiency is high and connection is fast.

Figure 1:
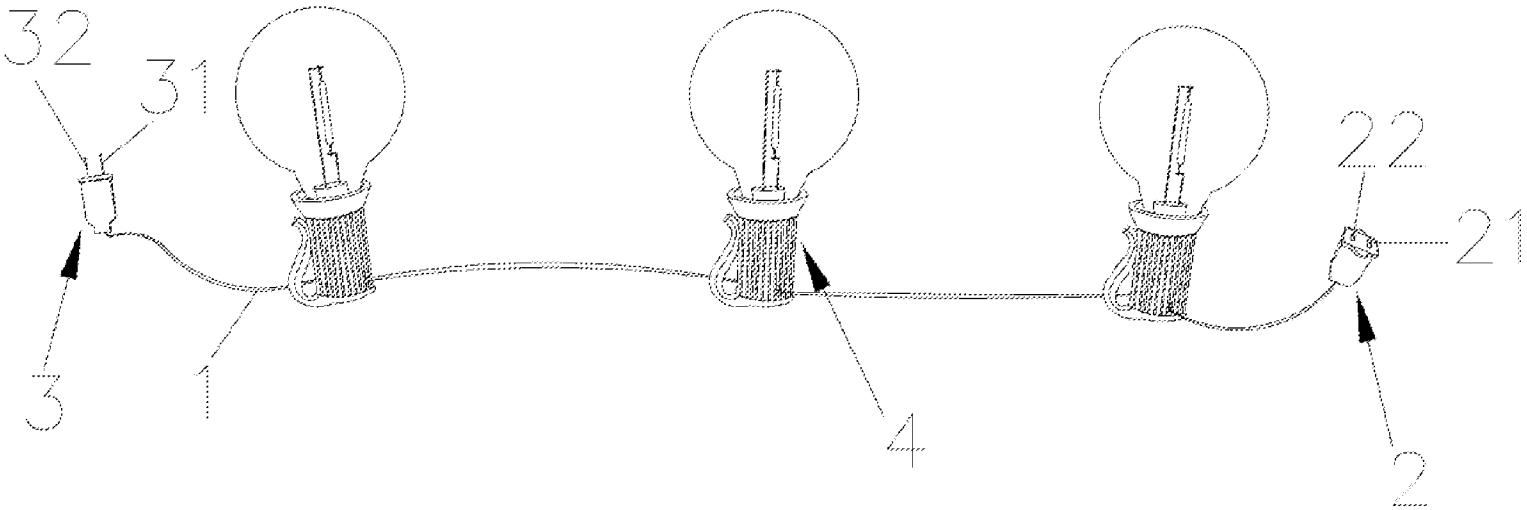
FIG. 1 is a schematic overall structural diagram of the present disclosure.

Reference numerals include:

Electric wire—1, female socket—2, first jack—21, second jack—22, male plug—3, first male tab—31, second male tab—32, sliding cover—33, protruding strip—331, fuse—34, fusant—341, supporting electrode—342, lamp—4, lamp holder—5, holder body—51, rotating accommodating position—511, first conductive terminal—512, second conductive terminal—513, pointed protruding portion—514, wire accommodating groove—515, buckling position—516, tail hood—52, clamping tongue—521, wire pressing strip—522, hook—523, bulb—6, plastic bulb shell—61, gap—7, water discharge port—8.

DETAILED DESCRIPTION

Figure 2:
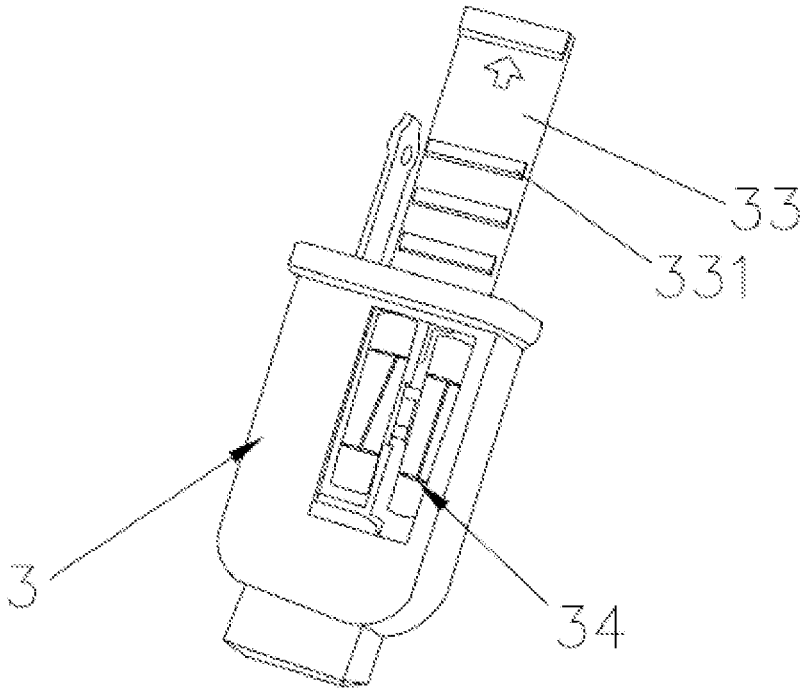
FIG. 2 is a schematic structural diagram of a male plug of the present disclosure.
Figure 3:
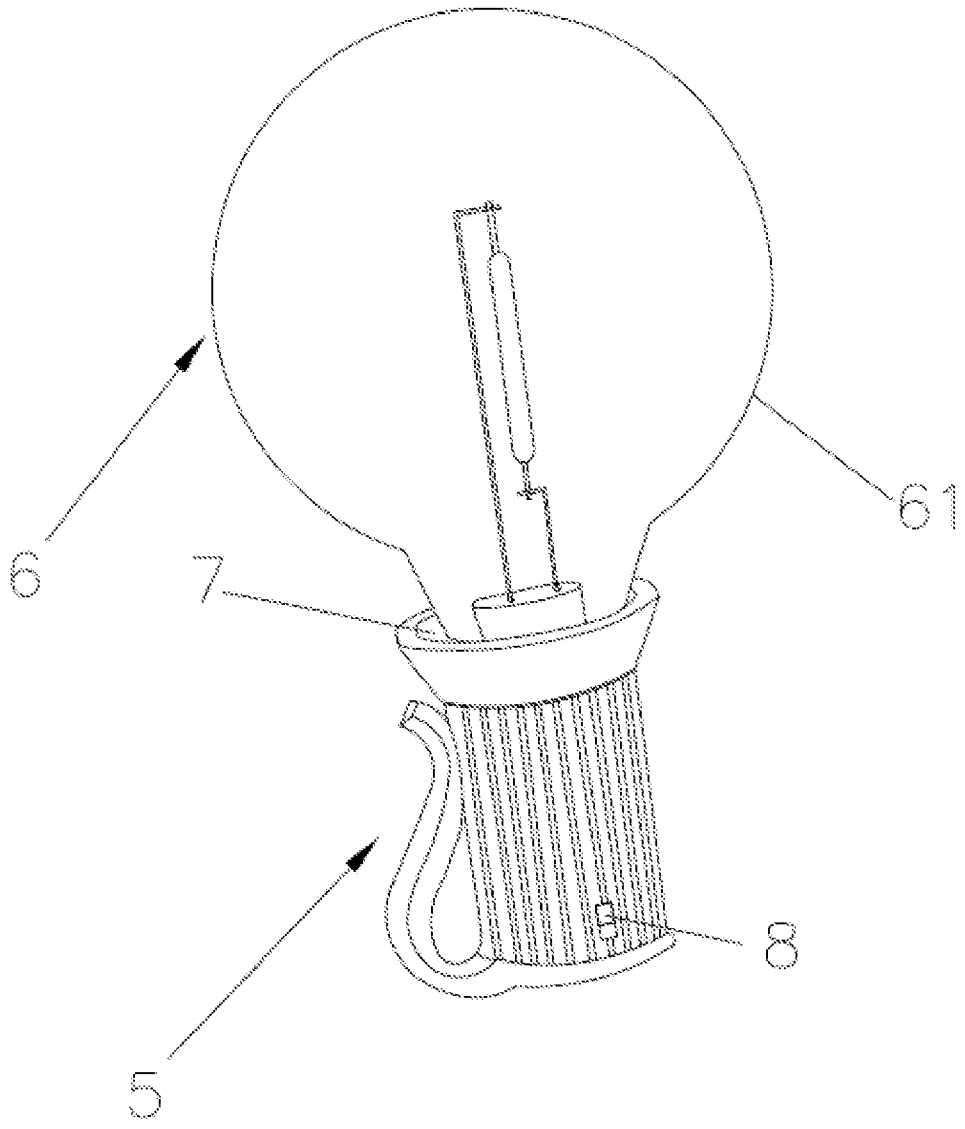
FIG. 3 is a schematic structural diagram of a lamp of the present disclosure.
Figure 4:
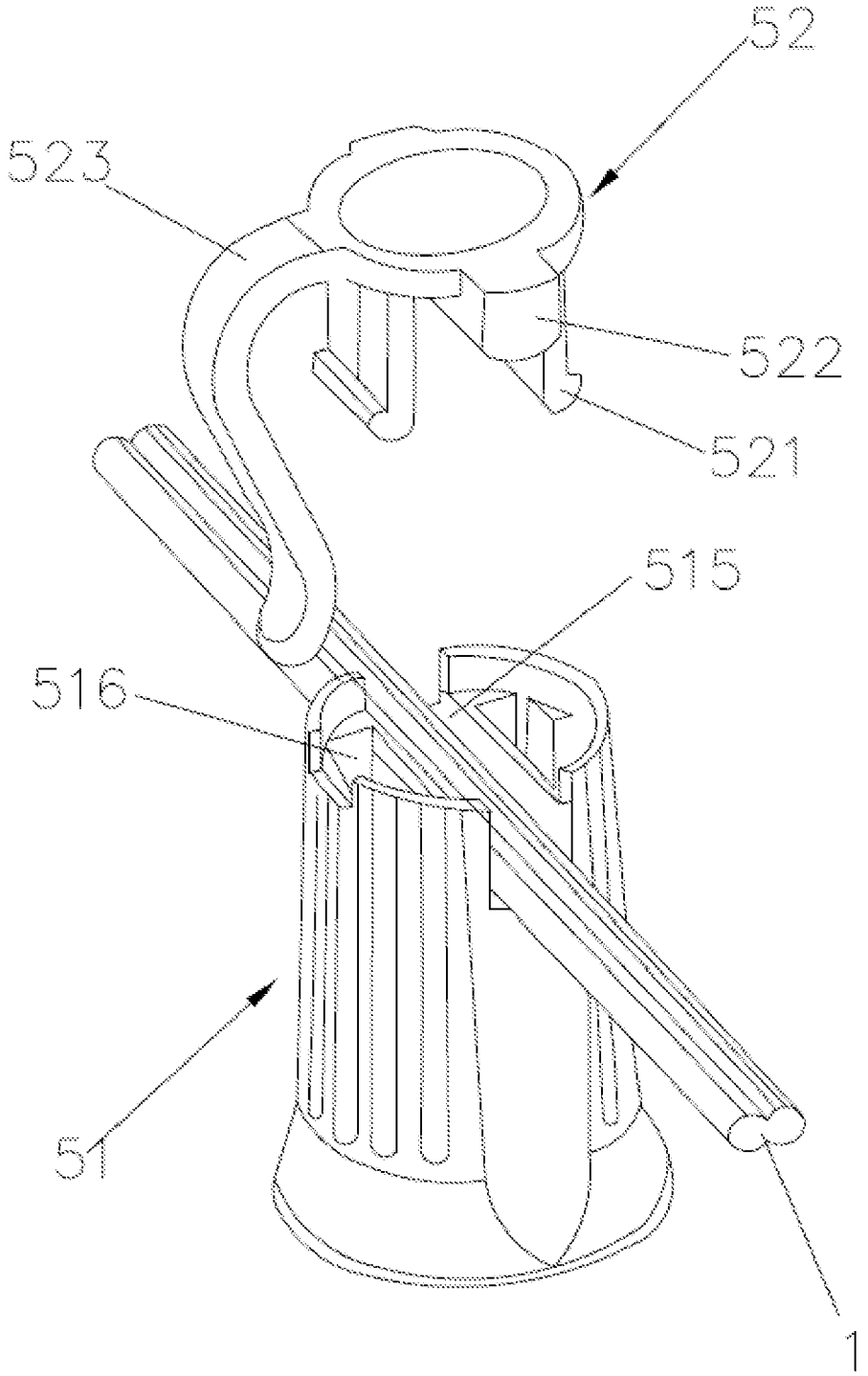
FIG. 4 is a schematic structural diagram of a lamp holder of the present disclosure.
Figure 5:
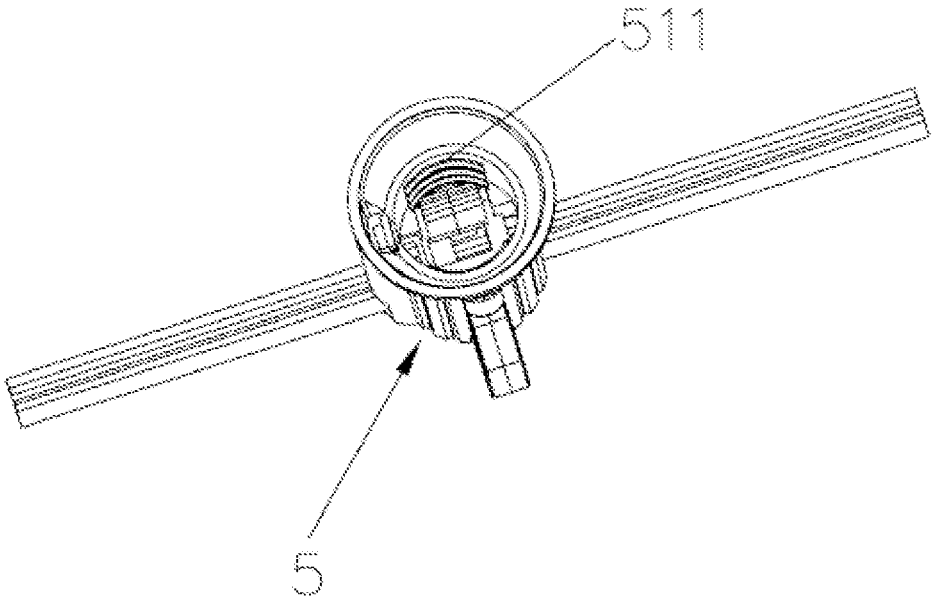
FIG. 5 is a schematic structural diagram of a lamp holder of the present disclosure.
Figure 6:
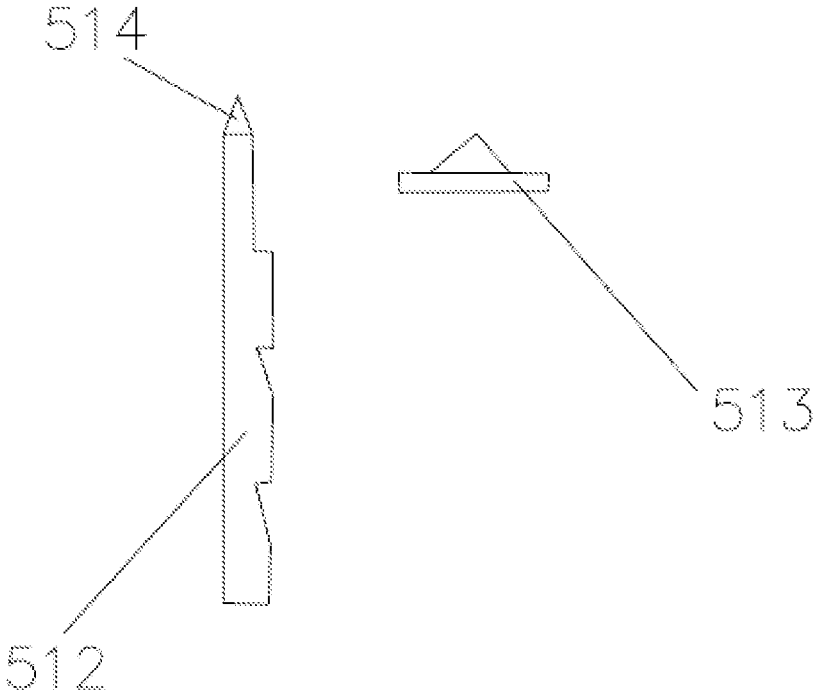
FIG. 6 is a schematic structural diagram of a conductive terminal of the present disclosure.
Figure 7:
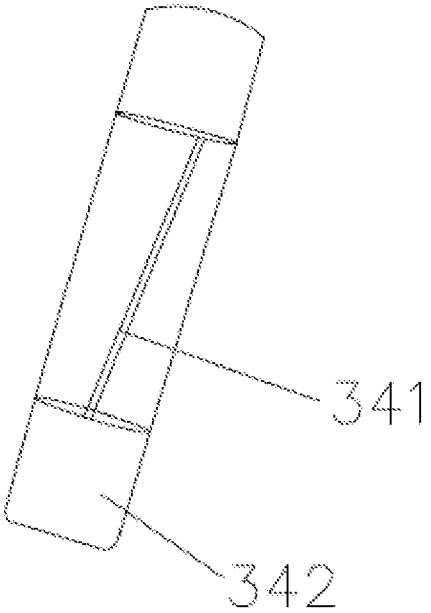
FIG. 7 is a schematic structural diagram of a security device of the present disclosure.

The present disclosure is explained in detail below in conjunction with FIGS. 1-7.

The present disclosure is a waterproof and shatterproof light string. The light string includes an electric wire 1. A female socket 2 is arranged at one end of the electric wire 1, and a male plug 3 capable of being plugged and electrically connected with the female socket 2 is arranged at the other end of the electric wire 1, and meanwhile, a plurality of lamps 4 of the same structure are arranged in the middle of the electric wire 1 in parallel at equal distances; the lamp 4 includes a lamp holder 5 and a bulb 6 connected with the lamp holder 5, a gap 7 is arranged between the lamp holder 5 and the bulb 6, and a water discharge port 8 is formed in one side of the lamp holder 5; and the bulb 6 includes a shatterproof plastic bulb shell 61. The present disclosure is mainly applied in parties, has functions of setting off atmosphere by contrast and enhancing an artistic effect and the like, overcomes defects of traditional light strings at the same time, and has advantages including being waterproof and shatterproof. Waterproofing mainly depends on that the gap exists during connection of the bulb 6 and the lamp holder 5, the water discharge port 8 is formed in a side surface of the lamp holder 5 at the same time, water can be discharged in time when water enters the lamp, use of the lamp is not affected, and the lamp is protected to a certain extent; and a shatterproof function is mainly reflected in that the bulb 6 is made of a plastic material, making the bulb light and not prone to shattering. The present disclosure has great significance for development of decorative lamps.

In the technical solution, the female socket 2 is provided with a first jack 21 and a second jack 22 of different sizes, and the first jack 21 is greater than the second jack 22; the male plug 3 is provided with a first male tab 31 and a second male tab 32, wherein the first male tab 31 is matched with the first jack 21, and the second male tab 32 is matched with the second jack 22. The advantage of the design lies in that mistaken plugging cannot occur in use of the light string, and short circuit damage of the lamp is avoided, and meanwhile, connection efficiency between the light strings is high, and connection is fast.

Preferably, the male plug 3 is provided with an inner cavity, and a plurality of security devices 34 are plugged in a cavity body; and the inner cavity is connected with a sliding cover 33 in a sliding mode, and the sliding cover 33 is provided with a plurality of protruding strips 331. The action of the sliding cover 33 lies in that an internal structure of the socket can be looked over conveniently, meanwhile, when the light string breaks down, a failure cause can be fast troubleshot, and maintaining is in time. The sliding cover 33 is provided with the plurality of protruding strips 331, and the sliding cover 33 can be opened by pushing the protruding strips 331.

Further, the security device 34 includes a fusant 341 and supporting electrodes 342, and two ends of the fusant 341 are connected with the supporting electrodes 342. The fusant 341 is the core of a fuse, and cuts off the current when it is fused. At the same time, the two supporting electrodes 342 are connected at the two ends of the fusant 341. The supporting electrodes 342 have good electrical conductivity to realize electrical connection between the fusant 341 and a circuit. When the light string is short-circuited, the fusant 341 electrically connected with the circuit quickly cuts off the current, which protects the lamp 4.

In the present disclosure, the lamp holder 5 includes a holder body 51 and a tail hood 52, and the holder body 51 is connected with the tail hood 52 in a clamped mode.

Further, a rotating accommodating position 511 is arranged in the holder body 51, a first conductive terminal 512 is arranged on a side surface of the rotating accommodating position 511, a second conductive terminal 513 is arranged at a bottom, the first conductive terminal 512 and the second conductive terminal 513 are connected with two poles of the bulb 6, the first conductive terminal 512 and the second conductive terminal 513 are each provided with a pointed protruding portion 514 for puncturing a wire rod, and electrical connection of the bulb 6 and the wire rod can be achieved without any tools.

Furthermore, the holder body 51 further includes a wire accommodating groove 515, the wire rod is arranged in the wire accommodating groove 515, and two sides of the wire accommodating groove 515 are provided with buckling positions 516.

Further, the tail hood 52 is provided with clamping tongues 521 capable of being connected with the buckling positions 516 in a clamped mode, and the buckling position 516 and the clamping tongue 521 are connected mutually in the clamped mode, so that the wire rod can be firmly fixed. Meanwhile, the tail hood 52 is further provided with a wire pressing strip 522 for abutting against the wire rod, the wire rod is prevented from shifting, and a wire pressing effect is better.

Preferably, an edge side of the tail hood 52 is provided with a hook 523. Due to the hook 523, the lamp 4 can be fixed anywhere outdoors, such as trees and walls, without other tools, and practicability of the light string is improved.

The above content is only the preferred examples of the present disclosure. For those of ordinary skill in the art, according to the ideas of the present disclosure, there will be changes in the specific implementation and the scope of application, and the content of the present description should not be understood as limitations to the present disclosure.

What is claimed is:

1. A waterproof and shatterproof light string, comprising an electric wire, wherein, a female socket is arranged at one end of the electric wire, a male plug capable of being plugged into and electrically connected with the female socket is arranged at the other end of the electric wire, and a plurality of lamps are arranged in the middle of the electric wire in parallel; each lamp comprises a lamp holder and a bulb connected with the lamp holder, and a gap is arranged between the lamp holder and the bulb, wherein the gap is a circumferential gap that is defined between the lamp holder and the bulb and that surrounds the bulb when the bulb is fitted inside the lamp holder; a water discharge port is defined in one side of the lamp holder; and the bulb comprises a shatterproof plastic bulb shell; wherein the gap is configured to lead water that comes inside the lamp holder to the water discharge port to be drained.

2. The waterproof and shatterproof light string according to claim 1, wherein, the female socket comprises a first jack and a second jack, and wherein the first jack has a greater size than the second jack.

3. The waterproof and shatterproof light string according to claim 1, wherein, the male plug is provided with a first male tab and a second male tab, the first male tab is greater than the second male tab, the first male tab is matched with a first jack, and the second male tab is matched with a second jack.

4. The waterproof and shatterproof light string according to claim 3, wherein, the male plug is provided with an inner cavity, and a plurality of security devices are plugged in a cavity body; and the inner cavity is connected with a sliding cover in a sliding mode, and the sliding cover is provided with a plurality of protruding strips.

5. The waterproof and shatterproof light string according to claim 4, wherein, the security device comprises a fusant and supporting electrodes, and two ends of the fusant are connected with the supporting electrodes.

6. The waterproof and shatterproof light string according to claim 1, wherein, the lamp holder comprises a holder body and a tail hood, and the holder body and the tail hood are connected in a clamped mode.

7. The waterproof and shatterproof light string according to claim 6, wherein, a rotating accommodating position is arranged in the holder body, a first conductive terminal is arranged on a side surface of the rotating accommodating position, a second conductive terminal is arranged at a bottom, and the first conductive terminal and the second conductive terminal are each provided with a pointed protruding portion for puncturing a wire rod.

8. The waterproof and shatterproof light string according to claim 6, wherein, the holder body further comprises a wire accommodating groove and two sides of the wire accommodating groove are provided with buckling positions.

9. The waterproof and shatterproof light string according to claim 6, wherein, the tail hood is provided with clamping tongues capable of being connected with the buckling positions in a clamped mode, and the tail hood is further provided with a wire pressing strip for abutting against the wire rod.

10. The waterproof and shatterproof light string according to claim 6, wherein, an edge side of the tail hood is provided with a hook.

11. The waterproof and shatterproof light string according to claim 6, wherein the tail hood comprises a round base plate, and two cantilever protrusions that both extend from a side of the round base plate and that are arranged side by side in parallel, wherein each cantilever protrusion has a free end that comprises a hook that faces outwards, the hook being used to be snap-fitted with the holder body, wherein the round base plate has a congruent shape with that of a bottom end of the holder body, and wherein when the round base plate is fitted with the bottom end of the holder body, the round base plate fully covers the bottom end of the holder body.

* * * * *